US008077094B2

(12) United States Patent
Anderson et al.

(10) Patent No.: US 8,077,094 B2
(45) Date of Patent: Dec. 13, 2011

(54) PLASMA DEVICE WITH LOW THERMAL NOISE

(76) Inventors: Theodore R. Anderson, Brookfield, MA (US); Igor Alexeff, Oak Ridge, TN (US)

( * ) Notice: Subject to any disclaimer, the term of this patent is extended or adjusted under 35 U.S.C. 154(b) by 581 days.

(21) Appl. No.: 12/324,876

(22) Filed: Nov. 27, 2008

(65) Prior Publication Data

US 2009/0134803 A1 May 28, 2009

Related U.S. Application Data

(60) Provisional application No. 60/990,830, filed on Nov. 28, 2007.

(51) Int. Cl.
*H01Q 1/26* (2006.01)
*H01J 7/24* (2006.01)

(52) U.S. Cl. ..... 343/701; 343/785; 118/723 R; 315/111.21

(58) Field of Classification Search ..... 343/701, 343/873; 315/111.21, 111.41; 118/723 R, 118/723 I
See application file for complete search history.

(56) References Cited

U.S. PATENT DOCUMENTS 5,304,279 A * 4/1994 Coultas et al. ..... 156/345.49
5,558,718 A * 9/1996 Leung ..... 118/723 E
5,594,456 A * 1/1997 Norris et al. ..... 343/701
6,369,763 B1 * 4/2002 Norris et al. ..... 343/701
6,870,517 B1 3/2005 Anderson
6,922,173 B2 7/2005 Anderson
7,145,512 B2 * 12/2006 Metz ..... 343/701
7,274,333 B1 9/2007 Alexeff
7,292,191 B2 11/2007 Anderson
7,342,549 B2 3/2008 Anderson
7,453,403 B2 11/2008 Anderson

OTHER PUBLICATIONS

D.C. Jenn, "Plasma Antennas: Survey of Techniques and Current State of the Art," Naval Postgraduate School, Monterey, CA, Rep. NPS-CRC-03-001, Sep. 2003.*

* cited by examiner

*Primary Examiner* — Jacob Y Choi
*Assistant Examiner* — Amal Patel
(74) *Attorney, Agent, or Firm* — Knox Patents; Thomas A. Kulaga

(57) ABSTRACT

A plasma device having low thermal noise, which results in a high signal-to-noise ratio (SNR) of the plasma device. The plasma device includes devices with a plasma that is responsive to electromagnetic radiation and/or electrical signals. In various configurations, the plasma device has a plasma in which the temperature, resistance, pressure, and/or collision frequency are at a level sufficiently low to produce an acceptable level of noise. In another configuration, the operating frequency of the plasma device is at a level sufficiently high to produce an acceptable level of noise. Decreasing the noise level results in increasing the signal-to-noise ratio and increasing the data rate. The plasma temperature is reduced by operating the plasma device in the afterglow state. The plasma electron temperature is reduced by confining high energy electrons in a potential well and by using an electron emitting filament.

15 Claims, 3 Drawing Sheets

PLASMA DEVICE WITH LOW THERMAL NOISE

CROSS-REFERENCE TO RELATED APPLICATIONS

This application claims the benefit of U.S. Provisional Application No. 60/990,830, filed Nov. 28, 2007.

STATEMENT REGARDING FEDERALLY SPONSORED RESEARCH OR DEVELOPMENT

Not Applicable

BACKGROUND OF THE INVENTION

1. Field of Invention

This invention pertains to a plasma device with low thermal noise. More particularly, this invention pertains to a plasma device in which the device parameters are selected to provide an optimum noise level and signal-to-noise ratio.

2. Description of the Related Art

The signal-to-noise ratio (SNR) is the power ratio between a signal and noise. A high SNR is desirable because noise corrupts the signal, potentially reducing the bandwidth of the signal. Sources of noise include both external and internal sources. External sources include man-made noise, such as radio-frequency interference (RFI), and naturally generated noise, such as lightning and background or black body radiation. Internal sources include thermal noise generated by the various components of the circuit.

For electrical devices that conduct or are responsive to very low level signals, the SNR is one factor considered in the design of the device. Low signal levels are often encountered in sensor circuits and receiver front ends. For example, an antenna is a device that is responsive to electromagnetic waves, either transmitted or received. The performance of the antenna is affected by its SNR, with a high SNR being desirable. Increasing the SNR requires increasing the signal and/or decreasing the noise. In some cases, after the antenna design and configuration is optimized, a limit for signal sensitivity is reached where the internal sources of noise become significant to the SNR.

FIG. 1 illustrates a conventional metal wire loop antenna 100 that includes a pair of leads 104 providing an electrical connection to the wire loop 102. It is known to use metal antennas with various configurations, for example, dipole, folded dipole, beam, and loop. The antenna 100 is made of a conductive metal and its physical properties, such as length and arrangement, determine its electrical properties.

Nyquist's Theorem describes the noise power spectral density for commonly encountered noise, that is, for thermal noise for the type of electrical components in existence in 1928, when Nyquist developed the theorem. The Nyquist Theorem is applicable to metal based antennas and conductors and at low frequencies. The noise power spectral density for a metal antenna 100, $H(f)_{metal}$, is given by the following equation:

$$H(f)_{metal}=4kTR \quad (1)$$

where $H(f)_{metal}$ is in units of volts$^2$ per Hertz, k is Boltzmann's constant in joules per Kelvin, T is the temperature of the metal in degrees Kelvin, and R is the resistance of the metal in Ohms.

As can be seen, reducing the temperature and or resistance reduces the noise power spectral density for a metal antenna 100. But, the physical properties of metal and the constraints of signal propagation do not often allow the temperature and resistance to be lowered. For example, refrigeration units add mass and bulk to systems, which is not desirable for airborne and other applications. An example of the impracticality of trying to reduce resistance is for systems that have a very high frequency such that the skin effect comes into play. The skin effect causes the effective resistance of a conductor to increase with the frequency of the current.

BRIEF SUMMARY OF THE INVENTION

A plasma device having reduced thermal noise is disclosed. In particular, the plasma device is operated in such a manner that the temperature, resistance, and/or collision frequency are reduced and/or the operating frequency is increased to produce an acceptable level of noise and SNR. These parameters are changed indirectly or directly by taking advantage of the Ramsauer-Townsend effect, by operating in the afterglow state, by reducing the plasma electron temperature, and/or by otherwise directly changing the parameters. In this way, the plasma device is operated without excessive thermal noise and with a high SNR in low level signal conditions as contrasted to comparable metal devices.

A plasma device with lower thermal noise than a metal device of comparable design is provided. In one embodiment, the plasma device is operated at a selected frequency with a selected gas pressure and temperature that results in a lower thermal noise level than that of a metal device operated at the same selected frequency and with a similar design. In one such embodiment, the plasma device is a plasma antenna. For the embodiment where the plasma device is an antenna, a decrease in the thermal noise corresponds to an effectively enhanced aperture of the antenna. In other embodiments, the device is a plasma conductor in which the noise generated from the plasma is maintained below a selected level. Such devices include, but are not limited to, plasma reflectors, plasma screens, plasma shields, plasma windows, plasma switches, plasma waveguides, plasma coaxial cables, plasma radomes, and plasma frequency selective surfaces.

A plasma, as described herein, is a partially ionized gas that provides an electrically conductive path, similar to a conductive metal. But, unlike a metal device in which its electrical properties are fixed within narrow limits because of its solid structure, a plasma is a complex state of matter and the electrical characteristics of the plasma are varied by adjusting various properties of the plasma. For example, the thermal noise is lowered in a plasma device by operating the plasma device with the Ramsauer-Townsend effect or when the plasma is in the afterglow state. In another example, the thermal noise is lowered by operating with a low plasma temperature, pressure, and/or resistance. In still another example, the thermal noise is lowered by operating with an elevated operating frequency. In yet another example, the thermal noise is lowered by reducing the electron temperature of the plasma and/or by increasing the electron density of the plasma.

In one embodiment, the physical dimensions and configuration of a plasma device are selected based on the operating frequency of the plasma device. The characteristics of the plasma are controlled to produce a plasma device having a low level of thermal noise. In one embodiment, the electron collision frequency is minimized relative to the operating frequency to reduce the thermal noise. In one such embodiment, a Ramsauer gas is used in the plasma device to reduce the electron-gas atom collision frequency.

In one embodiment, the plasma device is operated in a steady state. That is, the device is functional when the gas is being energized to create the plasma state. In another embodiment, the plasma device is operated in a pulsed-afterglow mode. That is, the device is functional after the excitation that creates the plasma state is removed from the gas.

In one embodiment, the plasma device is configurable during operation to select the thermal noise level and the effective aperture. Such selection is accomplished by varying one or more of the characteristics of the plasma device while the device is operating.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A plasma device with low thermal noise is disclosed. Although specific examples of plasma devices are described herein, for example, a plasma antenna 200-A, a person skilled in the art will recognize that the plasma device not limited to the provided examples. As used herein, a plasma device includes devices that include a plasma that is responsive to electromagnetic radiation and/or electrical signals. Examples of a plasma device include a plasma antenna, a plasma reflector, a plasma screen, a plasma shield, a plasma window, a plasma switch, a plasma waveguide, plasma circuit conductors such as a coaxial cable, a plasma radome, and plasma frequency selective surfaces.

Figure 1:
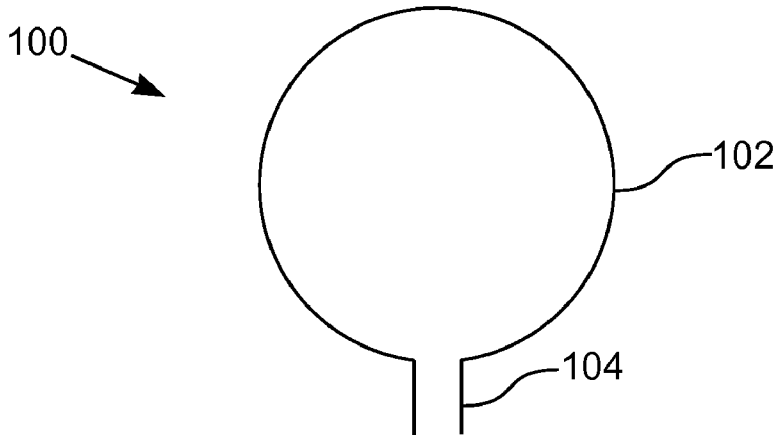
Fig. 1 (Prior Art)
FIG. 1 is a diagram of a conventional metal wire loop antenna.
Figure 2:
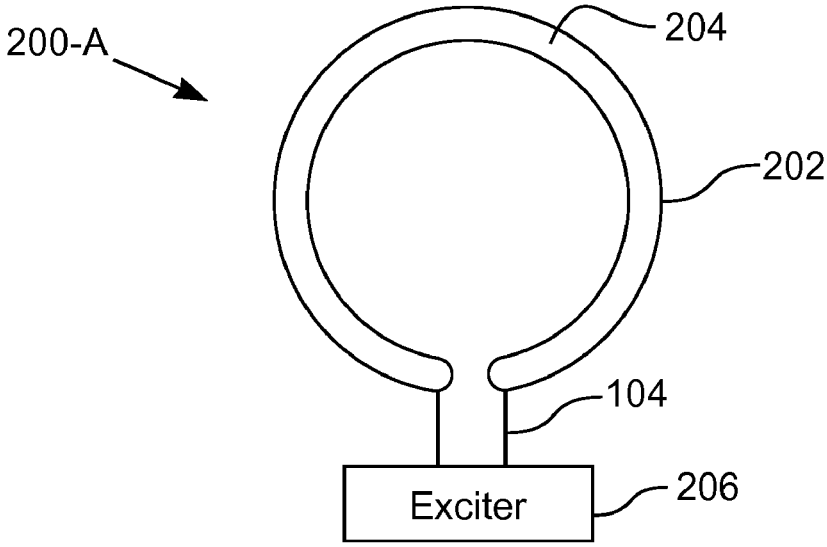
FIG. 2 is a diagram of one embodiment of a plasma loop antenna.

FIG. 2 illustrates one embodiment of a plasma device, namely, a plasma antenna 200-A. The illustrated plasma antenna 200-A is a loop antenna. In various embodiments, the plasma antenna 200-A has various configurations, for example, dipole, folded dipole, beam, and loop. The plasma antenna 200-A includes a vessel, or tube, 202 that contains a gas 204. Extending from the vessel 202 is a pair of leads 104 providing an electrical connection between the plasma 204 and an exciter 206.

The plasma vessel 202 is a non-conductive vessel or tube that has a chamber or cavity containing an ionized gas, or plasma, 204. In the illustrated embodiment, the vessel 202 is in the shape of a circular loop. In other embodiments, the plasma antenna 200-A has other geometric shapes suitable for its intended application. Examples of the various shapes and configurations of the plasma antenna 200-A include a linear dipole, a traveling wave antenna, a Yagi antenna, a log periodic antenna, a horn antenna, or an aperture antenna. Accordingly, the plasma vessel 202 is variously formed as a circular loop, a helix, a coil, an ellipse, a rectangle, a spiral or another shape, as appropriate. For a plasma antenna 200-A, the physical length of the cavity in the vessel 202 defines the electrical length of the plasma antenna 200-A.

In the illustrated embodiment, the pair of leads 104 are attached to electrodes in the vessel 202. The leads 104, in various embodiments, provide an electrical connection to the plasma 204 inside the vessel 202 and/or provide energy to excite the gas 204 to the plasma state. As an electrical connection, the pair of leads 104 connect the plasma 204 to a circuit (not shown in FIG. 2) via a feed line or a transmission line. The plasma 204 is a part of the circuit. In other embodiments, the plasma device 200-A is coupled to the circuit by other methods. Examples include applying a signal to the plasma 204 within the plasma vessel 202 through inductive couplers, capacitive sleeves, lasers, or by other devices that communicate electromagnetic signals with the plasma 204. Another example of coupling is by the plasma 204 reflecting, filtering, or otherwise interacting with an electromagnetic signal that is associated with the circuit.

The plasma vessel 202 contains a gas 204 inside the tube. In various embodiments of the invention, the gas 204 is a mixture that includes neon, xenon, argon and/or another noble gas, as well as mercury or sodium vapors or other materials that produce a suitable plasma 204. The gas 204 is ionized to form a plasma 204 in the plasma vessel 202 by applying energy to the gas 204. In various embodiments, an exciter 206 is a direct or external device for ionizing a gas to form a plasma 204. In the illustrated embodiment, the electrodes in the vessel 202 are connected to the leads 104, which are connected to an exciter 206 that provides the excitation energy for the plasma 204. When the gas 204 is ionized, a current flows between the leads 104 in the plasma vessel 204. In other embodiments, the gas 206 is excited by inductive couplers, capacitive sleeves, lasers, and/or RF heating.

After a plasma 204 is formed in the vessel 202, the plasma device 200-A is used as a component, or circuit element, in an electrical circuit. As with all electrical circuit elements, the plasma device 200-A generates internal noise. The noise power spectral density for a plasma device 200-A, $H(f)_{plasma}$, has been determined by the inventors to be represented by the following equation:

$$H(f)_{plasma} = 4kT\frac{R}{1+\frac{\omega^2}{\nu^2}} = 4kTR\frac{1}{\left(1+\left(\frac{\omega}{\nu}\right)^2\right)} \tag{2}$$

where $H(f)_{plasma}$ is in units of volts$^2$ per Hertz,
k is Boltzmann's constant,
T is the temperature of the plasma,
R is the resistance of the plasma,
ω is the operating angular frequency, and
ν is the electron-gas atom collision frequency.

The inventors determined that, in one embodiment, the resistance R of the plasma 204 of a plasma antenna 200-A is 26 ohms/meter and the temperature T of the plasma 204 is approximately $10^4$ degrees Kelvin. The collision frequency ν has been determined to be on the order of $10^9$ as calculated from the observed resistivity of a plasma antenna 200-A. For an operating frequency of 10 GHz resulting in an angular frequency ω of 2π times that operating frequency, the plasma antenna 200-A has less thermal noise than a comparable metal antenna 100. A comparable metal antenna 100 is one operating at the same frequency and of a similar type as the plasma antenna 200-A. A comparable metal antenna 100 with a resistance of 8 ohms/meter (because of the skin depth effect at such a high frequency) and a temperature of 300° Kelvin, which is approximately room temperature, has approximately 38 times the thermal noise of the above plasma antenna 200-A. The noise reduction in the described embodiment was achieved by selecting one or more of the operating parameters of the plasma antenna 200-A to be within certain limits.

Figure 3:
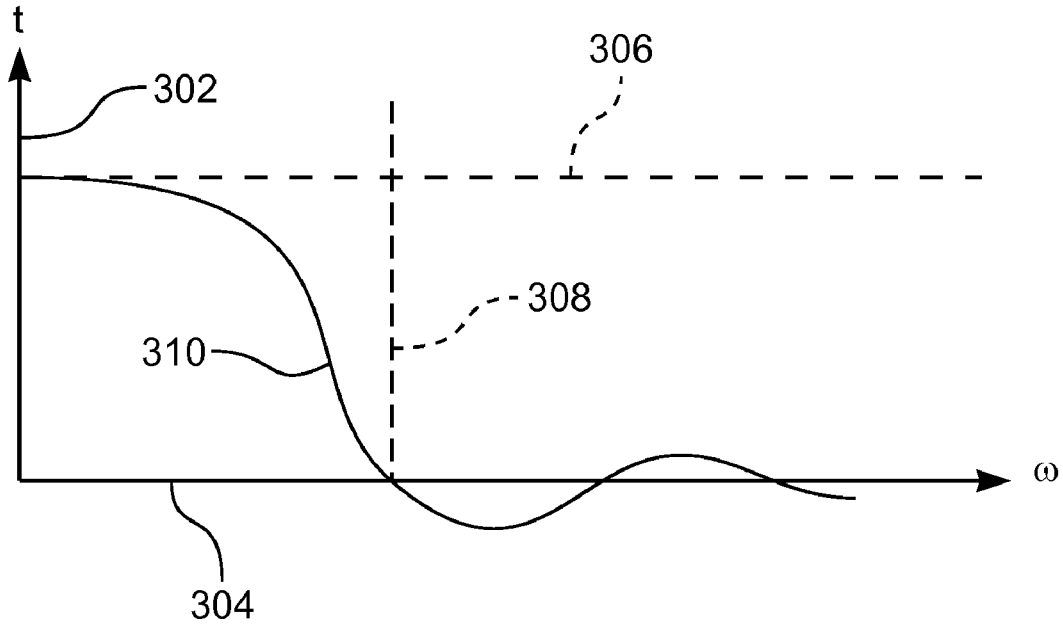
FIG. 3 is a graph showing the relationship between noise amplitude and angular frequency ω for a square wave pulse of duration Δt.

FIG. 3 illustrates a graph showing the relationship between noise amplitude 302 and angular noise frequency ω 304 of the noise. The curve 310 represents the noise amplitude 302 versus angular noise frequency 304. The curve 310 crosses the abscissa 304 at a point 308 equal to of $2\pi/\Delta t$ and the noise amplitude curve 310 then oscillates about the abscissa 304 with decreasing amplitude. The Δt is assumed to be a definite collision time.

Figure 4:
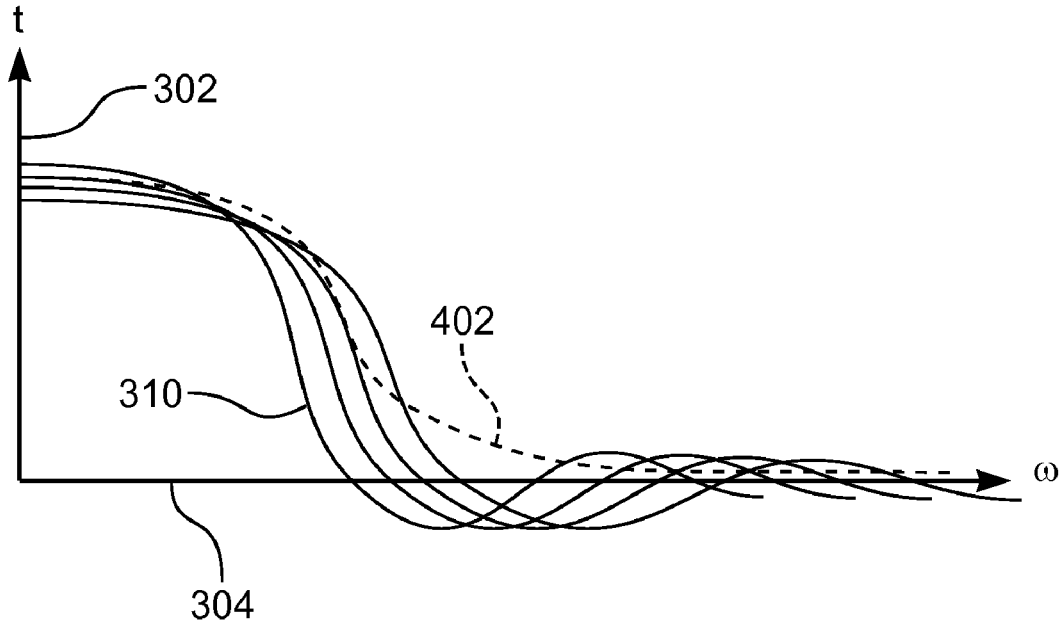
FIG. 4 is a graph showing the relationship between noise amplitude and angular frequency ω with variations for different values of Δt.

FIG. 4 illustrates a graph showing the relationship between noise amplitude 302 and angular noise frequency ω 304 with variations caused by multiple Δt collision times. Multiple noise amplitude curves 310 cross the abscissa 304 and produce a resulting, smoothed noise amplitude curve 402. In the event that the curves are summed over a collision distribution function shown below in (3), the frequency spectrum is that given above in Equation (2).

$$e^{\frac{-t}{t_c}}_{0\le t\le\infty} \tag{3}$$

where t is the collision time, and $t_c$ is the average collision time.

Figure 5:
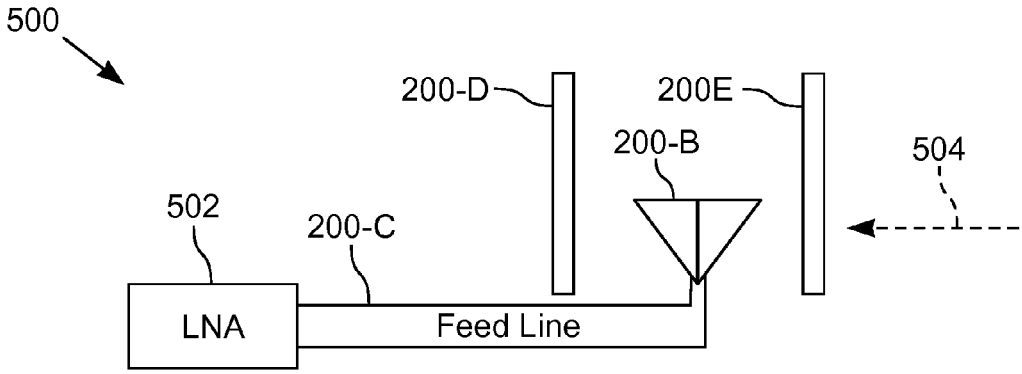
FIG. 5 is a block diagram showing one embodiment of a front end of a receiver.

FIG. 5 illustrates a block diagram showing one embodiment of a receiver front end 500. The components of the receiver front end 500 use plasma devices 200-C, 200-D, 200-E, 200-B to minimize the noise introduced by the circuit elements. A low noise amplifier (LNA) 502 is connected to a feed line 200-C that receives a signal from a plasma antenna 200-B. A plasma reflector 200-D is positioned to reflect electromagnetic radiation toward the plasma antenna 200-B. A plasma screen 200-E is positioned between the signal source and the plasma antenna 200-B. The illustrated configuration illustrates one application of plasma devices 200-C, 200-D, 200-E, 200-B that minimize thermal noise to enable reception of a low level signal 504. In other embodiments, various plasma devices are used to achieve specific goals in signal reception and processing.

The plasma antenna 200-B receives a portion of a low level signal 504 that is passed by the plasma screen 200-E and reflected by the plasma reflector 200-D. By operating the plasma screen 200-E and the reflector 200-D such that the devices 200-E, 200-D produce little thermal noise, the portion of a low level signal 504 reaching the plasma antenna 200-B is minimally corrupted by the thermal noise. The plasma antenna 200-B captures the low level signal, which is routed through the plasma feed line 200-C. In another embodiment, the plasma antenna 200-B and the low noise amplifier 502 are connected with plasma circuit conductors, for example, a plasma coaxial cable. Both the plasma antenna 200-B and the plasma feed line 200-C are operated such that the devices 200-B, 200-C produce little thermal noise, thereby minimally corrupting the portion of the low level signal 504 that is received by the low noise amplifier 502. The resulting signal processed by the low noise amplifier 502 has a high signal to noise ratio (SNR) as compared to a conventional circuit with metal-based components. Additionally, the effective aperture of the plasma antenna 200-B is increased over an equivalent metal antenna 100 because the plasma antenna 200-B is operated with a lower level of thermal noise than the equivalent metal antenna 100.

In one embodiment, the plasma devices 200 are configurable during operation. By changing the noise level during operation, the plasma device 200 is configurable to take advantage of the benefits related to different levels of SNR. For example, the plasma temperature T of the plasma antenna 200-B is increased when the antenna 200-B is in service in order to reduce the effective aperture of the plasma antenna 200-B to accommodate the specific conditions occurring at that time. In another example, the thermal noise of the plasma device 200 is increased, causing a decrease in the SNR. Doing so causes low level signals to be corrupted by the noise, which is desirable when the low level signal is interfering with the signal of interest.

Figure 6:
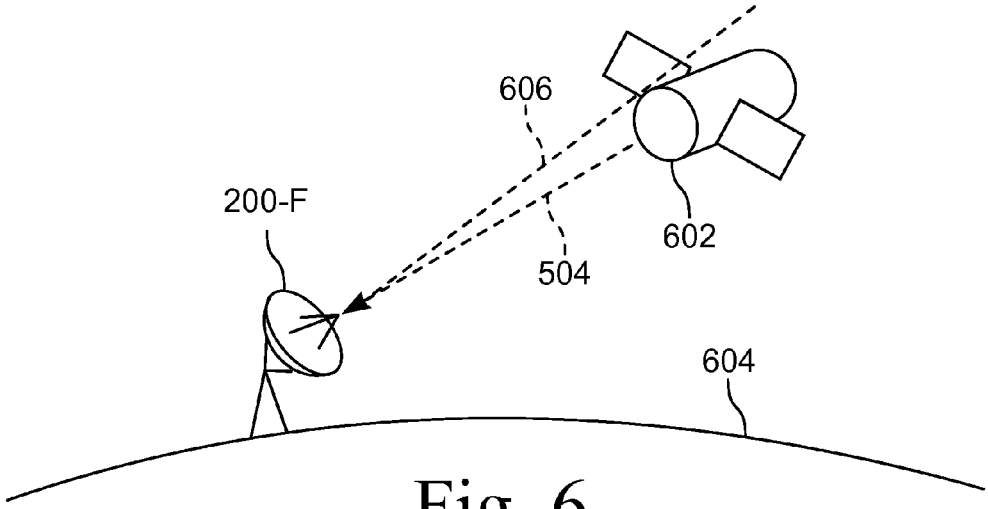
FIG. 6 is a pictorial of one embodiment of a plasma antenna aimed at a satellite.

FIG. 6 illustrates a pictorial of one embodiment of a plasma antenna 200-F aimed at a satellite 602. The plasma antenna 200-F receives a low level signal 504 from the satellite 602 that is above the earth 604. Coincident with the low level signal 504 is cosmic background radiation 606, which is external noise that corrupts the low level signal 504. The cosmic background radiation 606 has a thermal black body spectrum at a temperature of 2.7 degrees K. The thermal noise level of the cosmic background radiation 606 at 2.7 degrees K is contrasted to the background thermal noise of the Earth as seen from space at 255 degrees K.

Because the cosmic background radiation 606 is at such a low level, the plasma antenna 200-F is potentially responsive to low level signals 504 that cannot be detected by conventional metal antennas. For example, incorporating the low noise amplifier 502 and the feed line 200-C illustrated in FIG. 5 with the plasma antenna 200-F of FIG. 6 results in a system with low internal noise and high SNR.

Because the cosmic background radiation 606 is at such a low level, the minimum signal strength of the low level signal 504 that a system of plasma devices 200 is capable of receiving is limited by the internal thermal noise of the system. The internal thermal noise of such a plasma system is substantially less than that for a metal antenna. Accordingly, such a plasma system is capable of receiving low level signals 504 at a lower level of signal strength than a metal antenna.

A plasma device 200 with low thermal noise results in an increase in the data rate that the plasma device 200 is responsive to. That is, as the noise level decreases, the effective bandwidth of the plasma device 200 increases. Noise has a random distribution and accumulates as the square root of the integration time. The signal 504 is coherent and accumulates linearly over the integration time. For a plasma antenna 200 that has x times less thermal noise than an equivalent metal antenna 100, the plasma antenna 200 has a data rate of $x^2$ times that of the metal antenna 100. That is, the data rate for a plasma antenna 200 increases by the square of the reduction in thermal noise compared to a metal antenna 100.

The thermal noise of a plasma device 200 is reduced by operating the plasma device 200 with values of the variables identified in equation (2) selected to produce a desired level of thermal noise for an operating frequency of the plasma device 200. The variables include the plasma temperature T, the plasma resistance R, the collision frequency ν, and the operating frequency ω. Reducing the plasma temperature T, the plasma resistance R, and/or the collision frequency ν results in a lower thermal noise and higher SNR. Typically, the operating frequency ω is pre-determined, but for those embodiments where the operating frequency ω is selectable, a higher operating frequency ω results in a lower thermal noise and higher SNR.

A plasma device 200 constructed in accordance with the present invention has one or more characteristics or properties manipulated to produce an electrical element with low thermal noise, relative to an equivalent metal device. In various embodiments, the operating variables, or parameters, are changed indirectly or directly by taking advantage of the Ramsauer-Townsend effect, by operating in the afterglow state, by reducing the plasma electron temperature, and/or by otherwise directly changing the parameters.

In one embodiment, the Ramsauer-Townsend effect is used to reduce the collision frequency ν of the plasma device 200 E. The Ramsauer-Townsend effect is a physical phenomenon involving the scattering of low-energy electrons by atoms of the noble gases argon, krypton, and xenon. The collision frequency ν is reduced by having the plasma 204 include a constituent gas that is less susceptible to collisions. In various embodiments, the plasma 204 is composed of at least one Ramsauer gas, for example, xenon, krypton, and/or argon. The concentration of the Ramsauer gas in the plasma 204 is such as to produce a desired level of thermal noise for an operating frequency of the plasma device 200.

In another embodiment, the temperature is reduced by operating the plasma device 200 with the plasma 204 in its afterglow state, that is, after the excitation of the plasma 204 is removed. Energy excites the gas 204 in the vessel 202 to ionize the gas 204 into the plasma state. The excitation energy increases the kinetic energy of the particles in the plasma 204, which increases the temperature of the plasma 204. The plasma temperature decreases when the energy of excitation is removed and the plasma 204 is allowed to cool. The afterglow of the plasma 204 occurs when the excitation energy is removed and while the plasma 204 is still ionized.

In one such embodiment, the excitation energy is applied to the plasma device 200 as a pulse stream with the plasma 204 being in the afterglow state between the pulses. The plasma device 200 is used as a circuit element during the periods between pulses when the plasma 204 is in the afterglow state. In this way, the temperature T of the plasma 204 is substantially less than when the excitation energy is applied to the plasma device 200. The frequency of the pulse stream is such that the information in the low level signal 504 is received. For example, referring to FIG. 5, one or more of the plasma devices 200 have their excitation removed and the low noise amplifier 502 is then switched on to sense the portion of the low level signal 504 that passes through the feed line 200-C. In one embodiment, a switch or switching circuit controls the excitation energy applied to the plasma devices 200 and also controls the operation of the devices 502 in communication with the plasma devices 200.

The temperature of the plasma 204 includes two components, the temperature of the electrons and the temperature of the gas atoms, ions, and other heavy particles. Thermal plasmas 204 have the electrons, gas atoms, ions, and heavy particles in substantial thermal equilibrium. Non-thermal plasmas 204 have the electrons at a much higher temperature than the ions and heavy particles. In various embodiments, the electron temperature, or the thermal kinetic energy per particle, T of the plasma 204 is reduced to produce a desired level of thermal noise.

In various embodiments, the electron temperature of the plasma 204 is reduced to produce a desired level of thermal noise. It is not uncommon for a non-thermal plasma 204 to have an electron temperature of approximately 10,000 degrees Kelvin.

Figure 7:
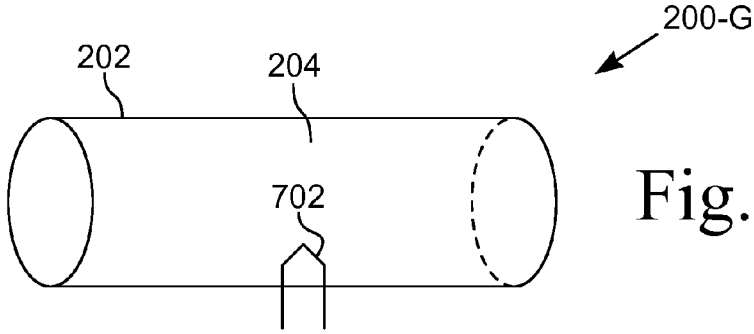
FIG. 7 is a schematic of one embodiment of a plasma device with a filament.

FIG. 7 illustrates a schematic of one embodiment of a plasma device 200-G with a filament 702. In the illustrated embodiment, the electron temperature of the plasma 204 is reduced by a filament 702 that causes cold electrons to be displaced into the plasma 204. In one such embodiment, the filament 702 is tungsten and reduces the temperature by a factor of approximately 5. In one such embodiment, the filament 702 is positioned inside the plasma 204. The hot electrons are confined in a positive potential, or electrostatic potential well. The hot electrons are attracted to the filament 702, which replaces the hot, or energetic, electrons with cold electrons In various embodiments, the temperature of the plasma 204 is reduced to produce a desired level of thermal noise. For example, the excitation energy applied to the plasma device 200 is such that the temperature T of the plasma 204 is maintained at a low value.

In various embodiments, the resistance R of the plasma 204 is reduced to produce a desired level of thermal noise. Resistance is reduced by shortening the length of a conductive path, increasing its cross-sectional area, and/or decreasing its resistivity. For those embodiments in which the electrical length of the plasma device 200 is not preselected, the vessel 202 is sized to have a short length, thereby reducing the plasma resistance R. The length of the vessel 202 coincides with the current path through the plasma 204.

In another embodiment, the vessel 202 is sized to have a greater diameter or cross-sectional area, thereby reducing the plasma resistance R. The cross-sectional area of the vessel 202 coincides with a plane perpendicular to the current path through the plasma 204.

The resistivity of the plasma 204 is directly related to the resistance of the plasma 204. That is, by decreasing the resistivity, the resistance R is decreased and the noise is decreased. Equation (4) shows the variables that affect resistivity.

$$\rho = \frac{n_g \sigma \sqrt{\frac{kT_e}{m}}}{\frac{n_e e^2}{m}} \tag{4}$$

where ρ is the resistivity of the plasma,
$n_g$ is the number of gas atoms,
σ is the cross-section,
k is Boltzmann's constant,
$T_e$ is the electron temperature,
m is the mass,
$n_e$ is the number of electrons, and
e is the electron charge.

In various embodiments, the resistance R is reduced by configuring the plasma 204 by varying one or more plasma attributes as described in equation (4). The resistivity ρ, and the resistance R, is reduced by reducing the number of gas atoms, such as by reducing the pressure of the gas 204 in the vessel 202. The resistance R is reduced by reducing the cross-section, for example, by using a Ramsauer gas. The resistance R is reduced by reducing the electron temperature.

Increasing the plasma electron density, or the number of electrons in the plasma 204, results in lowering the resistance R. For example, pulsing the current or otherwise exciting the gas to increase the amount of ionization increases the plasma electron density, which lowers the resistivity ρ. The increase in plasma electron density increases the current density.

In one embodiment, the collision frequency ν is reduced to a level much less than the operating frequency ω to produce a desired level of thermal noise. Reducing the collision frequency ν to a value much less than the operating frequency ω results in the noise level of the plasma device 200 being reduced significantly. The electron-gas atom collision frequency ν is lowered by adjusting the gas pressure, lowering the electron temperature, and/or selecting a desirable gas 204.

The plasma 204 is a partially ionized gas. Reducing the pressure of the gas 204 reduces the density of the gas 204 and reduces the collision frequency ν. Paschen's Law describes the relationship of the breakdown voltage with respect to gas pressure. By operating a plasma device 200 at the low pressure end of Paschen's curve, the pressure or density of the gas 204 in the plasma device 200 is low with a correspondingly low level of noise. In various embodiments, the pressure of the gas 204 is reduced to a level that results in a desired level of thermal noise.

In one embodiment, the volume of the plasma vessel 202 is increased to reduce the operating gas pressure of the plasma 204. In one such embodiment, the diameter or cross-sectional area of the plasma vessel 202 is increased to reduce the gas pressure in accordance with Paschen's criterion. In another such embodiment, the length of the plasma vessel 202 is decreased. In another embodiment, the plasma device 200 is operated with an increased operating voltage and a low pressure in the plasma vessel 202.

A method of operating a plasma device 200 includes the steps of selecting a gas 204 that includes an ionizing constituent, exciting the gas 204 to form a plasma 204, and maintaining the plasma 204 such that the plasma 204 has a lower thermal noise level than a comparable metal device. In one embodiment, the step of selecting the gas 204 includes selecting a Ramsauer gas. In other embodiments, the method includes a step of configuring the gas into a plasma antenna 200 or other configuration suitable for the plasma device 200, 200-C, 200-D, 200-E. That is, the vessel 202 containing the gas 204 is selected to have a shape and arrangement suitable for the plasma device 200 to operate in a desired manner. The plasma antenna 200 has an effective aperture greater than a comparable metal antenna because the plasma antenna 200 has a data rate greater than a comparable metal antenna. In still another embodiment, the method includes the step of positioning an electron emitting filament in the gas 204 and the step of replacing high energy electrons with low energy electrons. In yet another embodiment, the method includes the step of coupling the plasma 204 to a circuit 502, 200-C communicating a signal 504 with the plasma 204.

The method further includes, in various embodiments, the step of controlling at least one variable to obtain a desired thermal noise in the plasma 204. The variables include the plasma temperature T, the plasma resistance R, the collision frequency ν, the operating frequency ω, and the electron density.

The plasma device 200 includes various functions. The function of decreasing thermal noise of a plasma device 200 is implemented, in one embodiment, by operating the plasma device 200 with values of the variables identified in equation (2) selected to produce a desired level of thermal noise.

The function of increasing the signal-to-noise ratio of a plasma device 200 is implemented, in one embodiment, by decreasing the thermal noise generated internally by the plasma device 200.

The function of increasing the effective aperture of a plasma antenna 200 is implemented, in one embodiment, by decreasing the thermal noise of the plasma antenna 200.

From the foregoing description, it will be recognized by those skilled in the art that a plasma device 200, has been provided. In various embodiments, one or more of the variables defining the noise power spectral density of the plasma device 200 is selected to produce a desired level of thermal noise. By reducing the noise level of the plasma device 200 as compared to a comparable metal device, the signal to noise ratio (SNR) is improved. A comparable metal device is a device that has similar electrical characteristics as the plasma device 200, for example, a comparable metal antenna is the same type as a plasma antenna 200. For a plasma antenna 200, the effective aperture is increased or enhanced, making the plasma antenna 200 more sensitive than a comparable metal antenna. For a plasma antenna 200, the data rate is increased as compared to a comparable metal antenna.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A plasma device with a selected thermal noise level, said plasma device comprising:

a vessel defining a chamber, said vessel being electrically non-conductive;

a gas contained in said chamber, said gas being ionizable;

an exciter configured to ionize said gas in said chamber to form a plasma, and plasma having a lower thermal noise level as compared to a metal device having a comparable configuration;

a circuit coupled to said plasma, said circuit configured to communicate a signal with said plasma; and an electron emitting filament in said chamber, said electron emitting filament configured to replace high energy electrons with low energy electrons.

2. The plasma device of claim 1 wherein said plasma defines an antenna responsive to electromagnetic radiation, said antenna having an effective aperture greater than said metal device.

3. The plasma device of claim 2 wherein said antenna has a greater data rate than said metal device.

4. The plasma device of claim 1 wherein said gas is a Ramsauer gas.

5. The plasma device of claim 1 wherein said plasma has a resistance less than said metal device.

6. The plasma device of claim 1 wherein said plasma has a collision frequency that is less than an operating frequency.

7. The plasma device of claim 1 wherein said plasma has a pressure defined by a low pressure portion of Paschen's curve.

8. An apparatus with a selected thermal noise level, said apparatus comprising:

a vessel defining a chamber, said vessel being electrically non-conductive;

a gas contained in said chamber, and gas being ionizable; and an exciter configured to ionize said gas in said chamber to form a plasma, said plasma having a lower thermal noise level than a comparable metal device, said plasma is coupled to a circuit, said circuit communicating a signal with said plasma; and an electron emitting filament in said chamber, said electron emitting filament configured to replace high energy electrons with low energy electrons.

9. The apparatus of claim 8 wherein said vessel is configured to define a device selected from a group including an antenna, a reflector, a circuit conductor, a waveguide, a coaxial cable, a screen, a radome, and a frequency selective surface.

10. The apparatus of claim 8 wherein said plasma defines an antenna responsive to electromagnetic radiation, said antenna having an effective aperture greater than said metal device.

11. A method of operating a plasma device such that the plasma device has a selected low thermal noise level, said method comprising the steps of:

a) selecting a gas that includes an ionizing constituent;

b) positioning an electron emitting filament in said gas;

c) exciting said gas to form a plasma;

d) replacing high energy electrons with low energy electrons;

e) coupling said plasma to a circuit communicating a signal with said plasma; and f) maintaining said plasma such that said plasma has a selected minimum signal to noise ration.

12. The method of claim 11 wherein said step a) of selecting said gas further includes the step of selecting a Ramsauer gas.

13. The method of claim 11 further including, after said step a) of selecting, a step of configuring said gas into an antenna having an effective aperture greater than a comparable metal antenna.

14. The method of claim 11 further including, after said step a) of selecting, a step of configuring said gas into an antenna having a data rate greater than a comparable metal antenna.

15. The method of claim 11 wherein said step f) of maintaining further includes the step of controlling at least one of a plasma temperature, a plasma gas pressure, a plasma resistance, and a collision frequency to obtain said selected minimum signal to noise ration.

* * * * *